US007543964B2

(12) United States Patent
Albou

(10) Patent No.: US 7,543,964 B2
(45) Date of Patent: Jun. 9, 2009

(54) LIGHTING MODULE FOR A MOTOR VEHICLE LIGHT HEADLAMP, AND HEADLAMP COMPRISING A MODULE OF THIS TYPE

(75) Inventor: Pierre Albou, Paris (FR)

(73) Assignee: Valeo Vision, Bobigny (FR)

( * ) Notice: Subject to any disclaimer, the term of this patent is extended or adjusted under 35 U.S.C. 154(b) by 231 days.

(21) Appl. No.: 11/696,290

(22) Filed: Apr. 4, 2007

(65) Prior Publication Data

US 2007/0236951 A1 Oct. 11, 2007

(30) Foreign Application Priority Data

Apr. 6, 2006 (FR) ..... 06 03062

(51) Int. Cl.
*F21V 7/00* (2006.01)
*F21V 14/04* (2006.01)

(52) U.S. Cl. ..... 362/298; 362/297; 362/516; 362/517; 362/518; 362/341

(58) Field of Classification Search ..... 362/297, 362/298, 346, 516–518, 538, 539, 545, 547
See application file for complete search history.

(56) References Cited

U.S. PATENT DOCUMENTS 6,966,675 B2 * 11/2005 Albou ..... 362/298
7,347,600 B2 * 3/2008 Albou ..... 362/517
2004/0130907 A1 7/2004 Albou
2005/0094402 A1 5/2005 Albou

FOREIGN PATENT DOCUMENTS

| | | |
|---|---|---|
| EP | 1434002 | 6/2004 |
| EP | 1528312 | 5/2005 |
| EP | 1528313 | 5/2005 |
| GB | 399121 | 9/1933 |

* cited by examiner

*Primary Examiner*—Sandra L O'Shea
*Assistant Examiner*—James W Cranson
(74) *Attorney, Agent, or Firm*—Jacox, Meckstroth & Jenkins

(57) ABSTRACT

Lighting module, for a headlamp, provided to produce a cut-off beam, this module admitting an optical axis and comprising: a folder arranged so as to allow the passage of the light rays originating from a first reflector, which intersect, in orthogonal projection in the substantially vertical plane comprising an optical axis, the optical axis of a second reflector between a focus and peak of the second reflector, and to reflect the rays originating from the first reflector which would intersect the optical axis of the second reflector on the side remote from the peak relative to the focus of this second reflector, with the second reflector located below the horizontal plane passing through the optical axis.

20 Claims, 3 Drawing Sheets

FIG.5
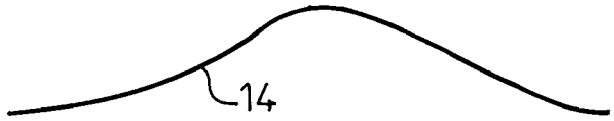
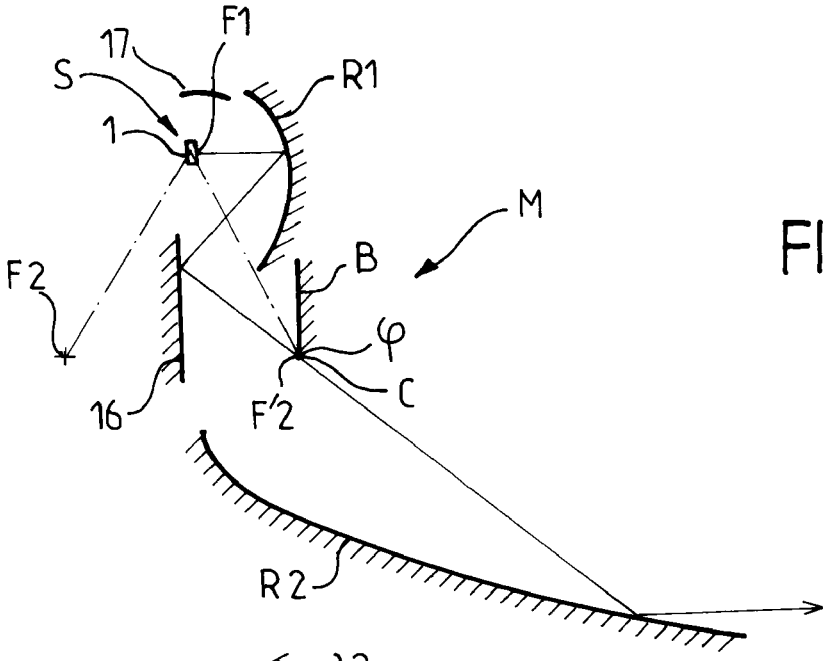
FIG.6
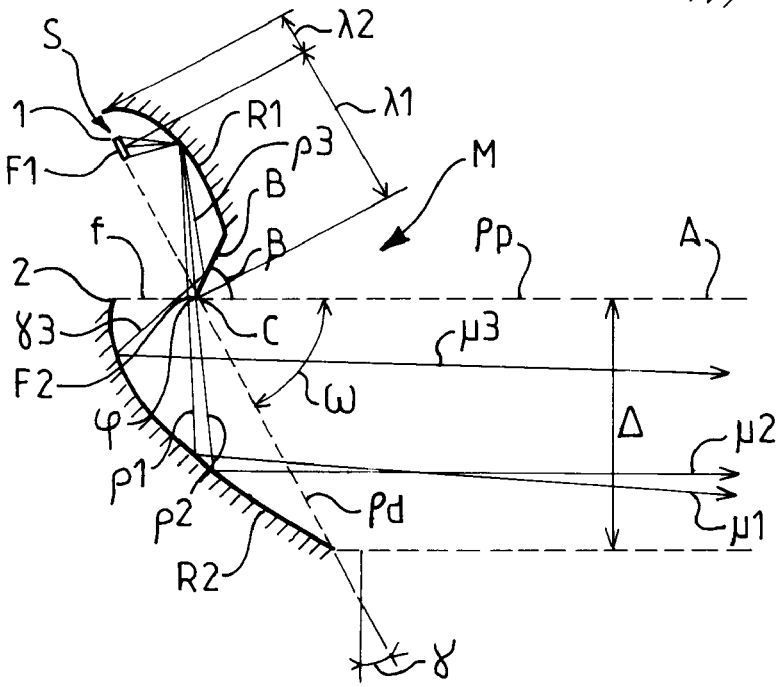
FIG.7

LIGHTING MODULE FOR A MOTOR VEHICLE LIGHT HEADLAMP, AND HEADLAMP COMPRISING A MODULE OF THIS TYPE

BACKGROUND OF THE INVENTION

1. Field of the Invention

The invention relates to a lighting module, for a motor vehicle light headlamp, provided to produce a cut-off beam, in particular a dipped beam.

2. Description of the Related Art

A lighting module of this type is known, for example, from U.S. Pat. No. 6,966,675. A module of this type is satisfactory with regard to the light beam obtained but presents problems for integration into the vehicle bodywork. The second, parabolic-type reflector, which is relatively large, is in the high portion generally corresponding to a smaller zone owing to the curved surface of the headlamp lens, necessitated by the design of the vehicle bodywork, hence the problem of integration therein.

There is, therefore, a need to provide an improved lighting module having a reduced overall size compared to modules of the past.

SUMMARY OF THE INVENTION

A first object of the invention is to provide a lighting module which has a reduced overall size in its high portion while at the same time allowing a cut-off beam to be obtained.

The light source generally consists of at least one light-emitting diode. In order to obtain a satisfactory light flux, use is made of a plurality of diodes arranged in a single plane and aligned to allow the weld connections and cooling of the diodes. The printed circuit board (PCB) is accordingly comparatively large in the transverse direction of alignment, resulting also in the problem of integrating a headlamp composed of a plurality of juxtaposed modules.

Another object of the invention is to provide a lighting module of the type defined hereinbefore that can easily be combined with other modules to allow the formation of a headlamp having a low overall transverse size.

Finally, the lighting module should remain relatively easy and economical to manufacture.

According to the invention, a lighting module for a motor vehicle light headlamp, of the type defined hereinbefore, is such that:

- the folder is arranged so as to allow the passage of the light rays, originating from the first reflector, which intersect, in orthogonal projection in the substantially vertical plane comprising the optical axis, the optical axis of the second reflector between the focus and peak of the second reflector, and to reflect the rays originating from the first reflector which would intersect the optical axis of the second reflector on the side remote from the peak relative to the focus of this second reflector, so the rays reflected toward the front by the second reflector move away from the optical axis thereof,
- and the second reflector is located below the horizontal plane passing through the optical axis when the module is positioned on the vehicle.

The light source can be located in the median plane of the folder.

The expression used hereinbefore, "in orthogonal projection in the substantially vertical plane comprising the optical axis", is a two-dimensional vision that is simple to express.

Remaining in a three-dimensional vision, the feature in question can be expressed in the following way: the folder is arranged so as to allow the passage of the light rays, originating from the first reflector, which intersect the (substantially) horizontal plane containing the optical axis between the focus and the peak of the second reflector.

The lighting module admitting an optical axis and being of the type of those comprising:

- at least one light source,
- a first, ellipsoidal-type reflector having a first focus where, or in the vicinity of which, the light source is arranged to emit light toward the first reflector, and a second focus located on or close to the optical axis of the module;
- a folder having a reflective surface and a cut-off edge,
- and a second, parabolic-type reflector for producing toward the front the cut-off beam of the module, the focus of the second reflector merging with, or being located in the vicinity of, the second focus of the first reflector, the optical axis of the second reflector merging with the optical axis of the module, and the cut-off edge of the folder passing through the focus of the second reflector, or in the vicinity thereof.

According to a first embodiment, the concave reflective surface of the first, ellipsoidal-type reflector is turned toward the front and the source emits light toward the rear, whereas the folder has a reflective surface turned toward the first reflector, the lower edge of the folder forming the cut-off edge.

Preferably, the median plane of the folder forms an angle of less than 90°, in particular approximately 45°, with the optical axis.

The light source can consist of at least one light-emitting diode turned toward the rear and a fin heatsink for dissipating the heat produced by the diode(s), is turned toward the front.

The cut-off edge of the folder can be curved, in a plane perpendicular to the folder, along a convex line descending either side of a peak having a horizontal tangent, to make rectilinear the cut-off line of the beam produced by the module.

According to a second embodiment, the light source is arranged to emit light toward the front, whereas the first reflector is turned to reflect toward the rear, the source being located at the first focus of the first reflector, the second focus of which is located further toward the rear than the first; a reflecting mirror is arranged below the source to intercept the light rays heading toward the focus, the rays being reflected to converge at a focal point forming the focus of the set formed by the reflector and the mirror, this focal point merging with, or being located in the vicinity of, the focus of the second, parabolic reflector.

The module can comprise, in addition to the first reflector, at the high end thereof, an ellipsoidal reflector sector having its first focus merged with the first focus of the first reflector and its second focus merged with the focal point, this sector allowing recovery of the light emitted by the source toward the base of the first reflector (on the side remote from the folder).

According to a third embodiment, the folder is arranged so as to close the elliptical mirror toward the front, the light source emitting light toward the front.

The median plane of the folder forms an angle with the plane of the source, the cut-off edge of the folder being formed by its lower edge passing through the focus of the second reflector.

Preferably, the surfaces of the two reflectors and the folder are conjugated surfaces such that:

- the first reflector, or collecting mirror, transforms a spherical wave derived from the center of the source into a wave surface reducing to the front edge of the folder, forming a two-dimensional curve;
- the second reflector, or reflecting mirror, transforms the preceding wave surface into a cylindrical wave having a vertical axis admitting the front edge of the folder as a cross section;
- the folder is a ruled surface consisting of a family of straight lines perpendicular to its front edge and forming a constant angle with the plane of the construction marker.

The cut-off edge of the folder can be rectilinear and the second reflector is in this case a parabolic cylinder.

The cut-off edge of the folder can be curved, substantially along a sine quarter.

The invention also relates to a light headlamp comprising in its lower portion at least one module as defined hereinbefore.

The light headlamp can comprise, in its high portion, a module having a light source emitting light toward the front, an ellipsoidal-type reflector located in front of the source and reflecting light toward the rear, the light source being located in a plane parallel to the folder of the lower module and, at the front, the plane of the source containing a folder located above the source, the upper edge of the folder forming the cut-off edge of the high module, which comprises a second, parabolic-type reflector located above the first reflector.

The light sources of the high and low modules advantageously consist of two light-emitting diodes, or series of light-emitting diodes, arranged on opposing faces of a single support.

According to another embodiment, the light headlamp comprises, in its lower portion, at least one module, the light source is arranged to emit light toward the front, and the light sources of the low and high modules consist of two light-emitting diodes, or series of light-emitting diodes, arranged on the same face of a printed circuit board support. The diodes are preferably aligned.

Advantageously, the first reflectors of the low and high modules of the headlamp are arranged substantially in the same region in the vertical direction, so that a dead zone, created in the beam by these reflectors, has a low height. The headlamp can comprise, in front of the dead zone, a low-height lighting function.

According to an advantageous embodiment, the headlamp comprises two sets of a plurality of superimposed modules.

Apart from the arrangements set out hereinbefore, the invention consists of a certain number of other arrangements, which will be explained hereinafter more specifically with regard to embodiments which are described with reference to the appended drawings but do not entail any limitation. In the drawings:

BRIEF DESCRIPTION OF THE DRAWINGS

FIG. 5 is a view on an enlarged scale of the cut-off edge of the folder, in the direction of arrow V in FIG. 3;

FIG. 6 is a schematic vertical section of a variation of the module according to the invention;

FIG. 7 is a schematic vertical section of another variation of the module according to the invention;

DESCRIPTION OF THE PREFERRED EMBODIMENTS

Figure 1:
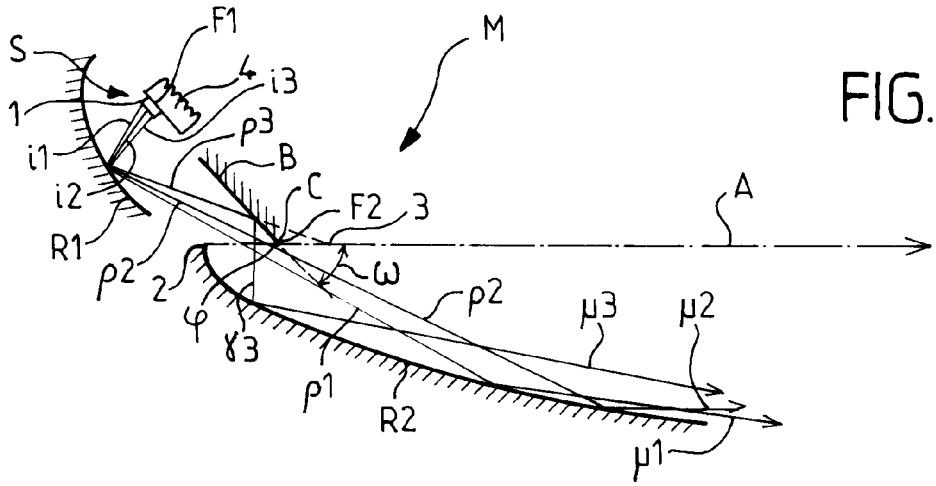
FIG. 1 is a schematic vertical section, passing through the optical axis, of a module according to the invention.

FIG. 1 shows, schematically represented, a lighting module M, for a motor vehicle light headlamp, provided to produce a cut-off beam, in particular a dipped beam. The module is illustrated in the position mounted on a vehicle, to emit light toward the front, i.e. toward the straight line shown in FIG. 1, the optical axis of the module being horizontal.

The module comprises a light source S consisting of at least one light-emitting diode 1 which emits light toward a first, ellipsoidal-type reflector R1, consisting of an ellipsoidal portion, or a portion having an ellipsoidal-like surface, turning its concave reflective surface toward the front. This reflector R1 comprises a first focus F1 on which (or in the vicinity of which) there is arranged the source S, which emits light toward the rear, and a second focus F2 located on, or in the vicinity of, the optical axis A of the module.

A folder B, which is basically planar as shown in FIG. 1, has a reflective surface turned toward the first reflector R1. The median plane of the folder B forms an angle $\omega$ with the optical axis A. Preferably, this angle $\omega$ is less than 90°, in particular approximately 45°. As shown in FIG. 1, the light source S is located in a plane containing the folder B. The expression "plane of the source" designates a plane which passes through the source and is orthogonal to the median direction of the radiation from the source. The lower edge C of the folder forms the cut-off edge.

A second, parabolic-type reflector R2 is arranged so as to reflect toward the front the cut-off beam of the module. The focus $\phi$ of the second reflector is merged with the second focus F2 of the first reflector R1, or located in the vicinity thereof.

The optical axis A of the module consists of the optical axis of the second reflector R2 merged with the geometric axis of this reflector. The reflector R2 can consist merely of a surface portion which stops before the geometric peak 2 of the parabolic section located on the geometric axis.

The cut-off edge C of the folder passes through the focus $\phi$ of the second reflector or in the vicinity thereof. The image of the edge C produced by the reflector R2 determines the cut-off line of the light beam of the module.

The folder B is arranged so as to allow the direct passage of the light rays, such as $\rho$1, which intersect the optical axis A of the second reflector R2 between the focus $\phi$ and the peak 2 of this second reflector. The ray $\rho$1 originates from the first reflector R1, after reflection of a ray i1 originating from the source S. A ray of this type ρ1 is reflected to μ1 by R2 toward the front in a direction moving away from the optical axis A from the rear toward the front.

The second reflector R2 is located below the horizontal plane passing through the optical axis A when it is positioned on the vehicle. Under these conditions, the reflected ray μ1 is directed downwardly below the cut-off formed by the image of the edge C produced by the reflector R2. The reflected ray μ1 will therefore not dazzle a driver coming in the opposite direction.

A ray such as ρ2, which is flush with the cut-off edge C, passes through the focus ϕ of the reflector R2 and is reflected in accordance with the ray μ2 parallel to the optical axis A.

A ray such as ρ3, which would intersect the optical axis A of R2 at a point 3 located on the side remote from the peak 2 relative to the focus ϕ, is reflected by the folder B in accordance with a ray v3 which intersects the optical axis A between the focus ϕ and the peak 2. This ray v3 is reflected by the second reflector R2, in accordance with a ray μ3 toward the front, which moves away from the optical axis A and therefore descends.

With the module of FIG. 1, the second, parabolic-type reflector R2, which is larger than the first reflector R1, is in the low portion and is easier to integrate into a bodywork, in view of the curved surface generally noted on vehicles. The beam remains of the cut-off type below an at least partially horizontal line to prevent dazzling of a driver coming in the opposite direction.

As shown in the example of FIG. 1, the optical surfaces of the module can be simple, ellipsoidal and paraboloidal. The distribution of the light is monitored by deformations of the collecting reflector R1 and the shape of the cut-off is determined by the edge C of the folder, which is "imaged" by the output paraboloid R2.

In view of the curved surfaces generally noted in vehicles and the optimization of the useful flux in the modules, having a given overall size, a low angle ω, of approximately 45°, is beneficially chosen.

At the location at which the light-emitting diodes 1 are turned toward the rear, a fin heatsink 4, for dissipating the heat produced by the diodes, is turned toward the front. This arrangement allows the creation of a design effect, the heatsink 4 being visible to an observer located in front of the vehicle.

Figure 2:
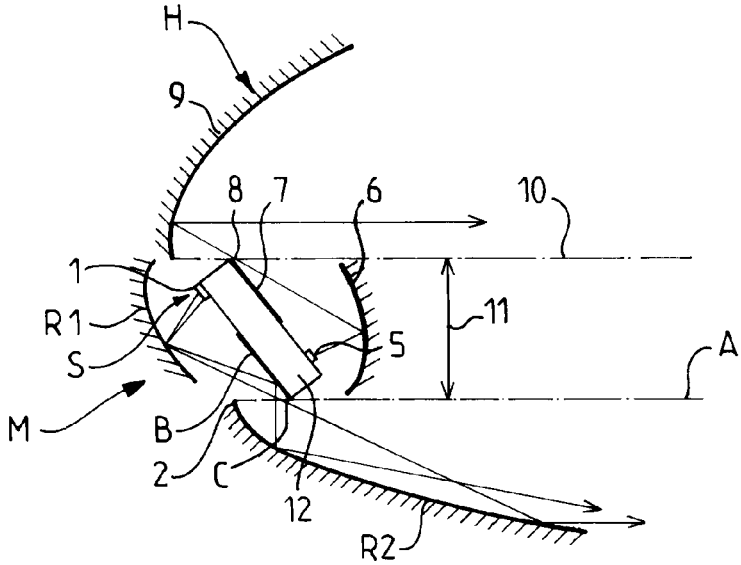
FIG. 2 is a schematic cross section, similar to FIG. 1, of a set of two modules.

FIG. 2 is a schematic cross section of a headlamp with, in the lower portion, a module M similar to that of FIG. 1, having a second reflector R2 located below the horizontal plane passing through the optical axis. The headlamp is provided, in its high portion, with a module H of the type described in U.S. Pat. No. 6,966,675, which is incorporated herein by reference and made a part hereof. The module H comprises a light source S, preferably formed by one or more light-emitting diodes, emitting light toward the front, and an ellipsoidal-type reflector 6 located in front of the source S and reflecting light toward the rear. The light source S is located in a plane parallel to the folder B of the lower module M, and in front thereof. The plane of the source S contains a folder 7 located above the source S. The upper edge 8 of the folder 7 forms the cut-off edge of the module H, which comprises a second, parabolic-type reflector 9. The reflector 9 is located above the first reflector 6 and the optical axis 10 of the module H merged with the optical axis of the reflector 9. The optical axis 10 is parallel to the optical axis A. The cut-off edge 8 of the folder 7 is located at the focus of the reflector 9 merged with the second focus of the reflector 6. The source S is located at the first focus of the reflector 6.

Advantageously, the first reflectors R1 and 6 are arranged substantially in the same region in the vertical direction, so that a dead zone 11, created in the beam by these reflectors, has a low height. It is possible to install, in front of this dead zone 11, a low-height lighting function, for example a DRL (daytime running light) function.

The light-emitting diodes 1, 5, like the associated folders B and 7, are arranged respectively on two opposing faces of a single support 12. The printed circuit boards (PCBs) for each of the diodes 1, 5 are therefore separated and located on the two opposing faces of the support 12. With an arrangement of this type, for dissipating the heat produced by each of the diodes, there is provided a device for cooling by blowing air, for example through passages (not shown) inside the support 12.

If the cut-off edge C of the folder B is rectilinear, the beam of the low module M has an upward convex cut-off line. For the high module H, if the cut-off edge 8 is rectilinear, the cut-off line of the beam obtained has a substantially V-shaped upward concave form.

Figure 3:
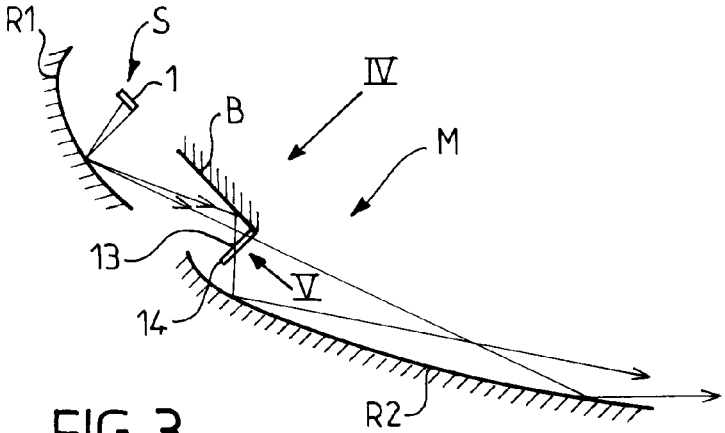
FIG. 3 is a cross section, similar to FIG. 1, of a variation of the module.

The cut-off line of the beam produced by the low module M can be made rectilinear by curving the edge of the folder C in a plane 13 (FIG. 3) perpendicular to the folder and containing its "imaged" edge. This curved edge 14, viewed face on, is illustrated in FIG. 5 and corresponds substantially to a sine portion, the peak of which, having a horizontal tangent, is located in the vicinity of the optical axis of the module M. The lateral ends of the edge 14 admit a substantially horizontal tangent.

To make rectilinear the cut-off line of the beam produced by the module H, the edge of the folder would be curved in the opposite direction to the edge 14.

Figure 4:
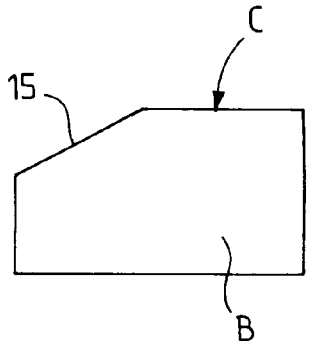
FIG. 4 is a view on an enlarged scale of a variation of the folder, in the direction of arrow IV in FIG. 3.

To create a light beam with a cut-off line rising at an angle of 15° relative to the horizontal, it is possible to cut a corresponding shape 15, as shown in FIG. 4, from the cut-off edge C of the folder in order to allow the passage of the rays liable to reach the zone at 15° of the beam.

The solution of FIG. 2 provides a high light flux. The overall transverse size is relatively low compared to a solution consisting in juxtaposing two high module-type modules H. However, the head-to-tail arrangement of the light-emitting diodes 1, 5 requires two printed circuit boards, one on each side of the support 12, and this entails additional production costs.

According to the embodiment shown in FIG. 6, the light-emitting diode 1 is arranged so as to emit light toward the front, whereas the first, ellipsoidal-type reflector R1 is turned to reflect toward the rear. The diode 1 is located at the first focus F1 of the reflector R1, the second focus F2 of which is located further toward the rear than the first. A vertical reflecting mirror 16, which is basically planar, is arranged below the diode 1, substantially in the plane thereof, to intercept the light rays heading toward the focus F2. The rays are reflected to converge at a focal point F'2 corresponding to the image of F2 produced by the mirror 16. This focal point F'2, which forms the focus of the set formed by the reflector R1 and the mirror 16, is merged with, or located in the vicinity of, the focus ϕ of the second, parabolic reflector R2 found in the lower portion. The folder B is located in a basically vertical plane, with its cut-off edge C formed by its lower edge passing through the focus ϕ.

There can be provided in addition to the reflector R1, at the high end thereof, an ellipsoidal reflector sector 17 having its first focus merged with F1 and its second focus merged with the point F'2. This sector 17 allows recovery of the light which is emitted by the diode 1 in directions close to the vertical and which, if it were reflected by R1, would be intercepted by the support of the diode 1 and would be lost.

The embodiment in accordance with FIG. 6 provides the light-emitting diode 1 turned toward the front so that, by combining the module of FIG. 6 with a high module such as H of FIG. 2, the light-emitting diodes of the two modules all emit light toward the front and can be installed on the same face of a printed circuit board PCB. Manufacture is thereby simplified, in particular for the production of the electrical connections. The heat released by the diodes can be discharged by a traditional heatsink located on the side of the PCB that is remote from the diodes. However, the set of the reflectors shown in FIG. 6 is relatively complex and cannot be unmolded in a single step.

FIG. 7 shows an advantageous variation in which the relative position of the folder B and the other surfaces of the reflectors R1, R2 is modified. The production advantages referred to hereinbefore are maintained.

The ellipsoidal-type reflector R1 and the parabolic-type reflector R2 preserve substantially the same relative positions as in the preceding embodiments, but the folder B closes, as it were, the front portion of the reflector R1. The median plane of the folder B forms an acute angle $\beta$ with the optical axis A. The cut-off edge C of the folder passes through the focus $\phi$ of the reflector R2 merged, or substantially merged, with the second focus F2 of the reflector R1. The folder B rises forward, from its cut-off edge C, to join the lower edge of the reflector R1. The light-emitting diode 1 is located at the first focus F1 of the reflector R1 and emits light toward the front, in the direction of this reflector R1.

The geometric axis of the reflector R1 forms an angle $\omega$ with the horizontal optical axis A and an angle $\gamma=\pi/2-\omega$ with the vertical direction.

$\Delta$ denotes the distance between the horizontal lines touching the ends of the reflector R2 and f denotes the focal distance from the reflector R2. This distance f corresponds to the distance between the focus $\phi$ and the peak 2 of this reflector. For fixed $\Delta$ and $\gamma$, the focal point f is determined by the reflection of the last ray $\rho d$ (FIG. 7). The angle $\beta$ is then determined by the reflection of the first ray $\rho p$ along the optical axis A.

In practice, the angle $\beta$ is increased by a strictly positive angle $\sigma$ (preferably 10°) in order to improve the flux yield. It is thus possible to recover some rays which are otherwise reflected toward the rear and the support of the diode 1. According to this variation, the folder B produces, in view of its orientation, the symmetry of the concentration spot of the second focus F2 in a plane which neither contains nor is perpendicular to any of the axes of the collecting ellipsoid R1. The light beam has to be deformed. Deformations of the primary mirror R1 are provided to allow the homogeneity of the beam to be controlled.

The control of the cut-off of the beam, which is performed by the cut-off edge C, can be carried out as follows, in the case of a flat cut-off light beam.

The three simple surfaces of the reflectors R1, R2 and the folder B are replaced by conjugated surfaces such that:

- the collecting mirror R1 transforms a spherical wave derived from the center of the source S into a wave surface reducing, for a particular optical path, to the front edge C of the folder, forming a two-dimensional curve;
- the reflecting mirror R2 transforms the preceding wave surface into a cylindrical wave having a vertical axis admitting the front edge C of the folder as a cross section;
- the folder is a ruled surface consisting of a family of straight lines perpendicular to its front edge C and forming a constant angle with the plane (O, x, y) of the construction marker.

Under these conditions, given: $\Delta$, $\omega$, the distance $\lambda$1 from the center of the diode 1 to the center of the front edge C of the folder, and the distance $\lambda$2 from the center of the diode 1 to the base of the collecting reflector R1, the desired surfaces are single and can be determined by explicit parametric equations. Beams which have a very clear cut-off and the distribution of which can be regulated by the shape given to the edge C of the folder are thus obtained.

Figure 8:
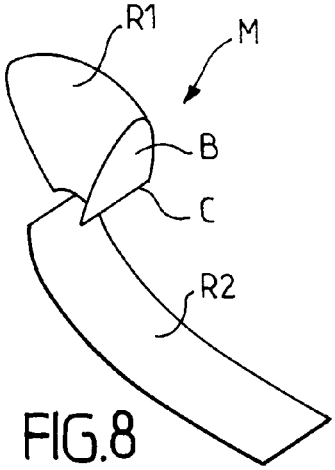
FIG. 8 is a schematic perspective view of the reflectors and the folder of the module shown in FIG. 7.
Figure 9:
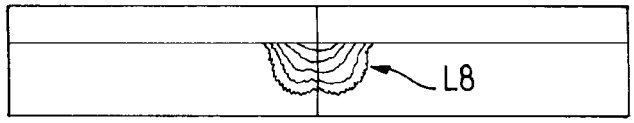
FIG. 9 illustrates the isolux curve network obtained with the module of FIG. 8.

FIG. 8 illustrates schematically in perspective a module as defined hereinbefore with a folder B, the cut-off edge C of which is rectilinear. The output reflector R2 is a parabolic cylinder. FIG. 9 illustrates the isolux curves L8 obtained on a screen positioned at a given distance from the module. The network of curves of FIG. 9 shows that the light beam of the module is relatively concentrated.

Figure 11:
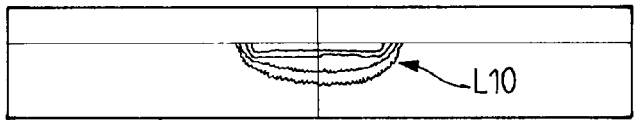
FIG. 11 illustrates the isolux curve network obtained with the module of FIG. 10.
Figure 10:
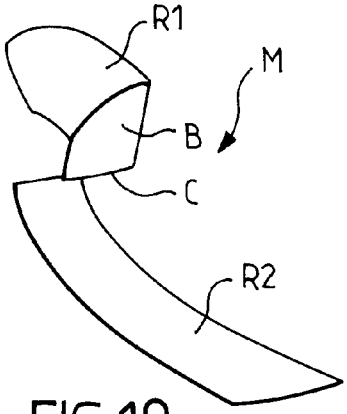
FIG. 10 shows, in a similar manner to FIG. 8, a variation.

FIG. 10 illustrates a variation of the module having three conjugated surfaces, according to which the cut-off edge C of the folder is curved, substantially along a sine quarter. The isolux network L10 of the light beam produced by a module of this type, illustrated in FIG. 11, shows that the beam is more spread out than in the case of the module of FIG. 8.

The third embodiment of FIGS. 7 to 11 provides a very clear cut-off and eliminates the risks of blurred cut-off and of dazzling. For the production of the module, requiring the presence of a drawer in the injection equipment, it is possible to mould all of the surfaces in one piece.

Figure 12:
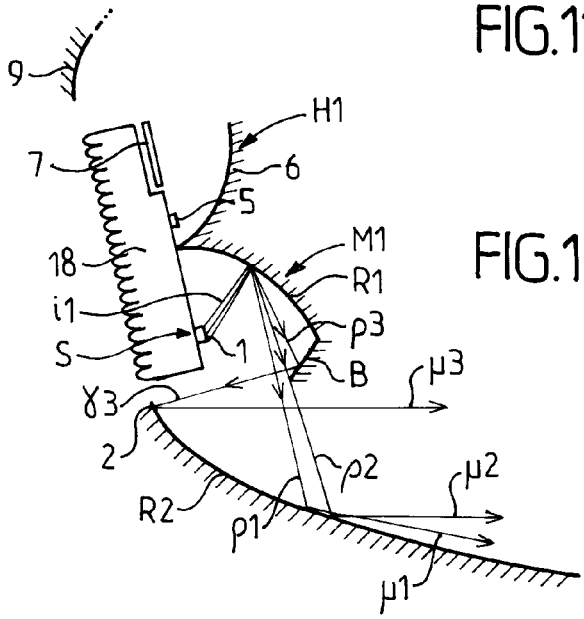
FIG. 12 is a schematic vertical section of a set of two superimposed modules.

FIG. 12 illustrates a set of two modules M1 and H1 in which the diodes 1 and 5 are located on a single side of the support, on a single printed circuit board, unlike in the case of FIG. 2. The diodes 1 and 5 can then be cooled conventionally by one or more heatsink elements 18 arranged behind the diode support.

Figure 13:
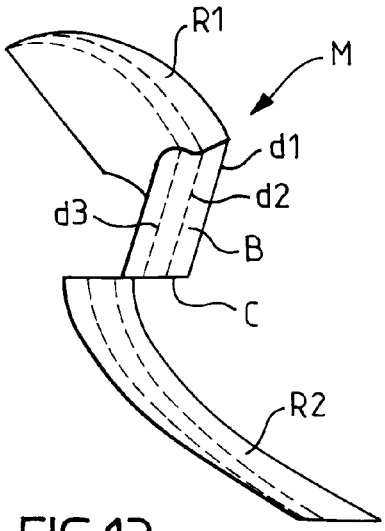
FIG. 13 is a side view of the reflectors and the folder of a module having conjugated surfaces.

FIG. 13 is a side view of the two reflectors R1 and R2 and the folder C which closes the lower portion of the reflector R1. The intersections of the folder B by planes orthogonal to the cut-off edge C are straight lines d1, d2, d3 which, viewed from the side, are parallel.

Figure 14:
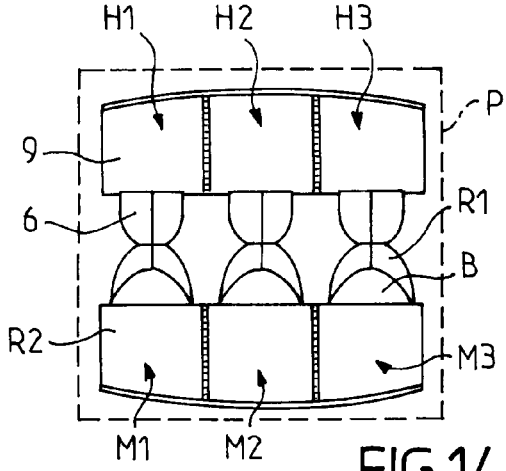
FIG. 14 is a front view of a headlamp formed of three sets of modules shown in FIG. 12.

FIG. 14 illustrates schematically, viewed face on, a headlamp P composed of three high modules H1, H2, H3 and three low modules M1, M2, M3 according to the invention. The headlamp P thus comprises two superimposed rows of modules, substantially symmetrical to one another relative to a median horizontal plane. The overall transverse size is relatively low for a headlamp, the light flux of which is high compared to a headlamp which, for producing the same light flux, would comprise six high module-type modules juxtaposed in a single row.

By arranging the light-emitting diodes on a single plane for industrial production, without having wires to weld, manufacture is simplified considerably. A light strip is basically produced, with a dark strip located on the side of the light strip that is remote from the second reflector. A dark strip of this type can be masked, especially by implanting additional lighting functions.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A lighting module, for a motor vehicle light headlamp, provided to produce a cut-off beam, in particular a dipped beam, this said module admitting an optical axis and comprising:

at least one light source;

a first, ellipsoidal-type reflector having a first focus where, or in the vicinity of which, said at least one light source is arranged to emit light toward the first reflector, and a second focus located on or close to the optical axis of the lighting module;

a folder, a reflective surface and a cut-off edge; and a second, parabolic-type reflector for producing toward front the cut-off beam of the lighting module, a focus of the second reflector merging with, or being located in the vicinity of, the second focus of the first reflector, an optical axis of said second reflector merging with the optical axis of the lighting module, and a cut-off edge of the folder passing through the focus of the second reflector, or in the vicinity thereof, wherein:

said folder is arranged so as to allow the passage of light rays, originating from the first reflector, which intersect, in orthogonal projection in a substantially vertical plane comprising the optical axis, the optical axis of the second reflector between the focus and peak of the second reflector, and to reflect the rays originating from the first reflector which would intersect the optical axis of the second reflector on a side remote from a peak relative to the focus of this second reflector, so the rays reflected toward the front by the second reflector move away from the optical axis thereof; and the second reflector being located below a horizontal plane passing through the optical axis when the module is positioned on the vehicle.

2. The lighting module according to claim 1, wherein the light source is located in the median plane of the folder.

3. The lighting module according to claim 2, wherein a concave reflective surface of the first, ellipsoidal-type reflector is turned toward the front and the source emits light toward the rear, whereas said folder has a reflective surface turned toward said first reflector, a lower edge of the folder forming the cut-off edge.

4. The lighting module according to claim 3, wherein a median plane of the folder forms an angle of less than 90°, in particular approximately 45°, with the optical axis.

5. The lighting module according to claim 3, wherein said at least one light source comprises at least one light-emitting diode turned toward the rear and in that a fin heatsink, for dissipating the heat produced by the diode(s), is turned toward the front.

6. The lighting module according to claim 1, wherein a cut-off edge of said folder is curved in a plane perpendicular to said folder along a convex line descending either side of a peak having a horizontal tangent, to make rectilinear the cut-off line of the beam produced by the module.

7. The lighting module according to claim 1, wherein said at least one light source is arranged to emit light toward the front, whereas said first reflector is turned to reflect toward the rear, said at least one light source being located at the first focus of the first reflector, the second focus of which is located further toward the rear than the first; a reflecting mirror is arranged below the source to intercept the light rays heading toward the focus, the rays being reflected to converge at a focal point forming the focus of the set formed by the reflector and the mirror, this focal point merging with, or being located in the vicinity of, the focus of said second, parabolic-type reflector.

8. The lighting module according to claim 7, which comprises, in addition to the first reflector, at the high end thereof, an ellipsoidal reflector sector having its first focus merged with the first focus of the first reflector and its second focus merged with the focal point, this sector allowing recovery of the light emitted by said at least one source.

9. The lighting module according to claim 1, wherein said folder is arranged so as to close the elliptical mirror toward the front, the light source emitting light toward the front.

10. The lighting module according to claim 9, wherein at the median plane of the folder forms an angle with the plane of the source, the cut-off edge of the folder being formed by its lower edge passing through the focus of the second reflector.

11. The lighting module according to claim 9, wherein the surfaces of the two reflectors and the folder are conjugated surfaces such that:

said first reflector transforms a spherical wave derived from the center of said at least one light source into a wave surface reducing to the front edge of the folder, forming a two-dimensional curve;

said second reflector transforms the preceding wave surface into a cylindrical wave having a vertical axis admitting the front edge of the folder as a cross section;

said folder is a ruled surface consisting of a family of straight lines perpendicular to its front edge and forming a constant angle with a plane of the construction marker.

12. The lighting module according to claim 11, wherein the cut-off edge of the folder is rectilinear and the second reflector is a parabolic cylinder.

13. The lighting module according to claim 11, wherein the cut-off edge of the folder is curved, substantially along a sine quarter.

14. A motor vehicle light headlamp comprising at least one module, in its high portion, with a light source emitting light toward the front, which comprises, in its low portion, at least one module according to claim 9 and in that the light sources consist of light-emitting diodes, or series of light-emitting diodes, arranged on the same face of a printed circuit board support.

15. A motor vehicle light headlamp, which comprises in its lower portion at least one module according to claim 1.

16. The light headlamp according to claim 15, which comprises two sets of a plurality of superimposed modules.

17. A light headlamp comprising a high portion comprising a module having a light source emitting light toward the front, an ellipsoidal-type reflector located in front of said light source and reflecting light toward the rear, said light source being located in a plane parallel to a folder of a lower module and, at the front, a plane of said light source containing a folder located above said light source, the upper edge of said folder forming the cut-off edge of the high module, which comprises a second, parabolic-type reflector located above said ellipsoidal-type reflector.

18. The light headlamp according to claim 17, wherein said light source consists of two light-emitting diodes, or series of light-emitting diodes, arranged on opposing faces of a single support.

19. The light headlamp according to claim 18, wherein that the first reflectors are arranged substantially in the same region in the vertical direction, so that a dead zone, created in the beam by these reflectors, has a low height.

20. The light headlamp according to claim 19, which comprises, in front of the dead zone, a low-height lighting function.

* * * * *